US009372053B2

(12) United States Patent
De Sa et al.

(10) Patent No.: US 9,372,053 B2
(45) Date of Patent: Jun. 21, 2016

(54) AUTONOMOUS WEAPON EFFECTS PLANNING

(71) Applicant: Raytheon Company, Waltham, MA (US)

(72) Inventors: Erwin M. De Sa, Tucson, AZ (US); David K. Barnett, Tucson, AZ (US); Jeffrey B. Saunders, Tucson, AZ (US); David E. Bossert, Tucson, AZ (US)

(73) Assignee: Raytheon Company, Waltham, MA (US)

( * ) Notice: Subject to any disclaimer, the term of this patent is extended or adjusted under 35 U.S.C. 154(b) by 223 days.

(21) Appl. No.: 14/011,543

(22) Filed: Aug. 27, 2013

(65) Prior Publication Data

US 2015/0059564 A1 Mar. 5, 2015

(51) Int. Cl.

| | |
|---|---|
| ***F41H 13/00*** | (2006.01) |
| ***F42C 99/00*** | (2006.01) |
| ***F41G 7/00*** | (2006.01) |
| ***F41G 9/00*** | (2006.01) |

(52) U.S. Cl.

CPC ..... *F41H 13/00* (2013.01); *F41G 7/007* (2013.01); *F41G 9/00* (2013.01); *F42C 99/00* (2013.01)

(58) Field of Classification Search

CPC ..... F41H 11/02
USPC ..... 89/1.11
See application file for complete search history.

(56) References Cited

U.S. PATENT DOCUMENTS

| | | | | |
|---|---|---|---|---|
| 5,458,041 | A * | 10/1995 | Sun | F41G 7/00 244/3.11 |
| 6,672,534 | B2 * | 1/2004 | Harding | G01S 7/22 244/3.1 |
| 6,997,097 | B2 * | 2/2006 | Harding | G01S 7/22 342/62 |
| 7,210,392 | B2 * | 5/2007 | Greene | F41G 3/06 89/1.11 |
| 8,069,127 | B2 * | 11/2011 | Taylor | G06N 3/126 706/13 |
| 2010/0269674 | A1 * | 10/2010 | Brown | G08B 15/00 89/1.11 |
| 2012/0000349 | A1 * | 1/2012 | Couronneau | F41G 3/04 89/1.11 |
| 2015/0316352 | A1 * | 11/2015 | Eriksson | F41G 9/00 89/1.11 |

* cited by examiner

*Primary Examiner* — Reginald Tillman, Jr.

(57) ABSTRACT

A method for autonomous weapon effects planning includes receiving the desired lethality and collateral effects information on a target and autonomously selecting at least one weapon and fuze setting from an inventory of weapons based on the received lethality and collateral effects information. The method further includes autonomously; determining which weapon with fuze setting and terminal elevation and heading angles satisfies the desired lethality and collateral effects; shaping weapon trajectory to satisfy weapon maneuverability, terrain clobber avoidance and guidance requirements and planning weapon launch conditions for the one or more autonomously selected weapons. The weapon launch conditions include at least a launch point or a launch corridor.

22 Claims, 7 Drawing Sheets

AUTONOMOUS WEAPON EFFECTS PLANNING

TECHNICAL FIELD

This disclosure is generally directed to weapon effects planning. More specifically, this disclosure is directed to autonomous weapon effects planning.

BACKGROUND

Current methods for weaponeering (pairing weapons with targets) and weapon fire control for Close Air Support (CAS) are conducted manually by pilots on armed aircrafts or remotely by pilots, flying armed unmanned aircrafts. This manual process is slow and rarely achieves the desired lethality or collateral effects at target. The lethality effects concern the warhead's capability to damage/destroy the target whereas the collateral effects describe the volume in which the fragments (weapon, target and nearby objects) and pressure caused by the warhead detonation can maim or kill living things and/or damage/destroy objects that are not the intended target. In addition, these tools are not designed for speed or simplified operator workflows. They are used to iterate through series of "what if's" to come up with the best solution, increasing the timeline and making the tool unsuitable for time sensitive targets.

SUMMARY

This disclosure provides a system and method for autonomous weapon effects planning.

A method for autonomous weapon effects planning includes receiving the desired lethality and collateral effects information on a target and autonomously selecting at least one weapon and fuze setting from an inventory of weapons based on the received lethality and collateral effects information. The method further includes autonomously; determining which weapon with fuze setting and terminal elevation and heading angles satisfies the desired lethality and collateral effects; shaping weapon trajectory to satisfy weapon maneuverability, terrain clobber avoidance and guidance requirements and planning weapon launch conditions for the one or more autonomously selected weapons. The weapon launch conditions include at least a launch point or a launch corridor.

Certain embodiments may provide various technical advantages depending on the implementation. For example, a technical advantage of some embodiments may include the capability to autonomously and rapidly select a weapon with fuze settings and terminal elevation and heading angles based on lethality and collateral effects information for a target. A technical advantage of other embodiments may include the capability to autonomously and rapidly plan optimized weapon launch conditions for the one or more autonomously selected weapons. Yet another technical advantage may include the capability to autonomously launch autonomously selected weapons according to autonomously planned weapon launch conditions.

Although specific advantages are above, various embodiments may include some, none, or all of the enumerated advantages. Additionally, other technical advantages may become readily apparent to one of ordinary skill in the art after review of the following figures and description.

BRIEF DESCRIPTION OF THE DRAWINGS

For a more complete understanding of this disclosure and its features, reference is now made to the following description, taken in conjunction with the accompanying drawings, in which.

DETAILED DESCRIPTION

Figure 1:
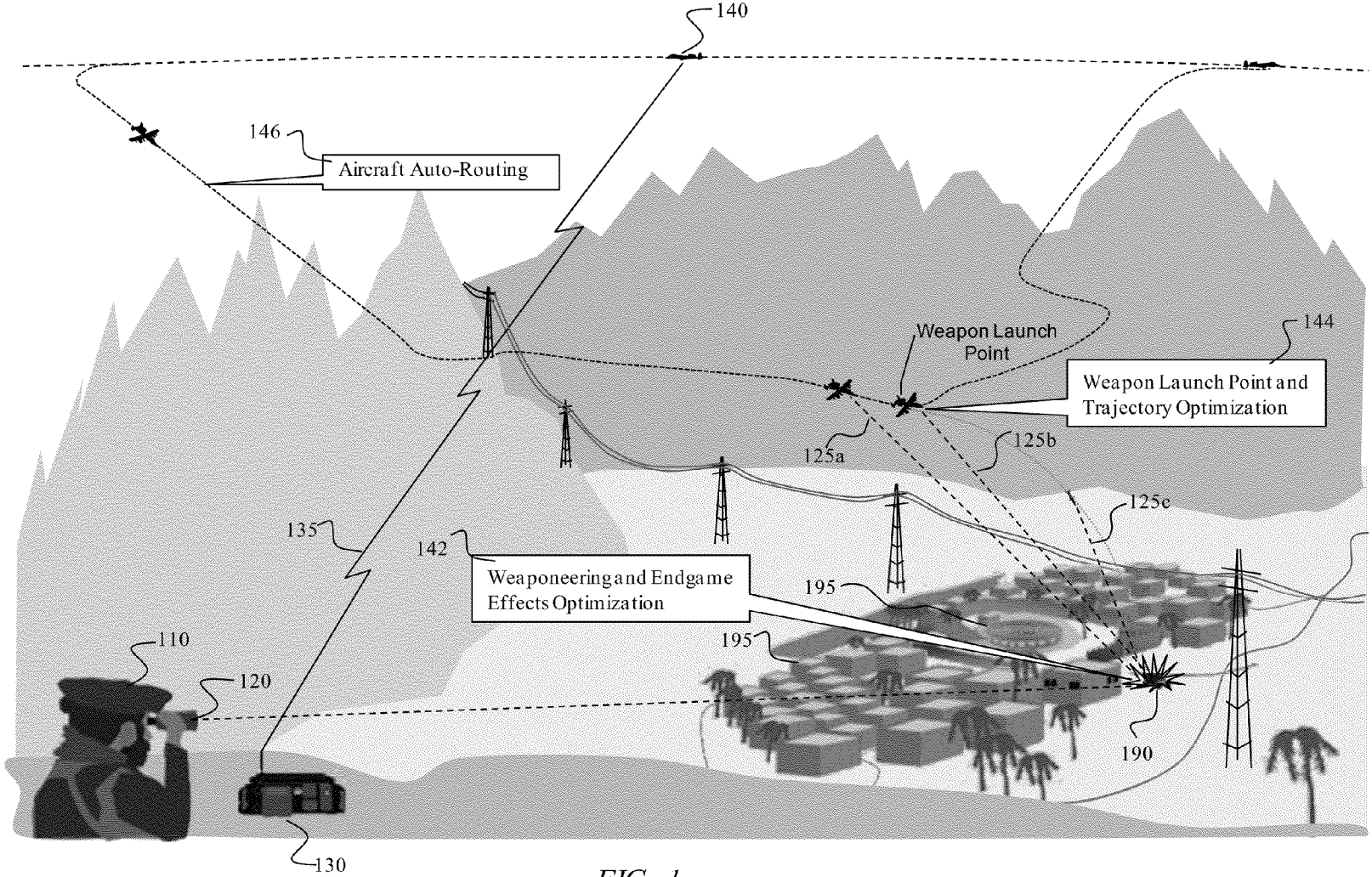
FIG. 1 provides a simplified diagram of an example operation, according to an embodiment of the disclosure.

FIGS. 1 through 7, described below, and the various embodiments used to describe the principles of the present disclosure in this patent document are by way of illustration only and should not be construed in any way to limit the scope of the disclosure. Those skilled in the art will understand that the principles of the present disclosure invention may be implemented in any type of suitably arranged device or system.

In a conventional operation, a Close Air Support (CAS) pilot or ground controller may use rules and software tools to match targets with available weapons. The matching of such targets with weapons is called "weaponeering." The operator of such a weaponeering process is called a "weaponeer." The rules are based on knowledge of weapon characteristics and experience with weapons employment. Non-limiting example rules include knowledge about weapon's guidance system, predicted guidance accuracy, predicted terminal velocity, warhead lethality against different targets and warhead fragmentation density and pattern.

For every target, the weaponeer processes through the available weapons in the inventory one by one using a tool. More specifically, within the tool, the weaponeer enters in a target type, a target location, a candidate weapon, fuze settings and weapon launch conditions (launch location, attitude and speed). In response, the tool outputs weapon lethality effects on target. In this process, the weaponeer is required to go through several time-consuming iterations before converging to a best fitting weapon target tie-up.

Once a best weapon to target fit is found, the pilot readies the weapon for launch and requests a display of the weapon launch acceptability region (LAR). The pilot then guides the aircraft towards the target. When the target is within the LAR, the pilot pulls the trigger to launch the weapon. If the weapon needs laser designation aiding, the pilot either uses the onboard sensor to laser designate the target or requests the CAS ground controller to laser designate the target.

Unfortunately, the above-described process is time consuming, relies on human intuition, and does not shape the weapon's trajectory or terminal heading and elevation angles resulting in a large collateral damage uncertainty at target.

With the onset of warfare scenarios in which time is of the essence (e.g., urban warfare) and the possibility of human error if a rush manual process is conducted, such conventional techniques become extremely undesirable.

Given such concerns with conventional techniques, certain embodiments disclose a system that greatly reduces the kill chain time line and significantly improves the capability to control the collateral damage at the target. According to certain embodiments, current weaponeering tools (lethality and collateral) and manual weaponeering processes are replaced with a system having rapidly processed, optimization algorithms for weapon selection, terminal weapon attitude and speed selection, and weapon trajectory shaping. Additionally, according to certain embodiments, the system also has rule based algorithms for weapon fuze setting and weapon terminal guidance planning. Moreover, according to certain embodiments, the system provides the weaponeer a graphical display of the selected weapon's effects on target and weapon trajectory. In some embodiments, this provides the weaponeer with enhanced situational awareness (SA) of the results of the autonomous weapons employment. In some embodiments, the weaponeer has the option to accept or reject the results or to scroll through all the weapons, in the inventory, rapidly accessing each weapon's suitability for an upcoming target engagement.

FIG. 1 provides a simplified diagram of an example operation, according to an embodiment of the disclosure. The operation begins with a Close Air Support (CAS) ground controller 110 conducting intelligence, surveillance, and reconnaissance (ISR) activities in a conflict area. As shown, there may be targeted areas 190 and keep-out zones 195.

The ground controller 110 has targeting equipment 120 to identify and recognize the target 190, a computer and datalink 130 with software tools configured to: describe the target 190, select lethality effects on the targeted areas 190, select the collateral effects on the target areas 190 (e.g., as may be imparted on keep-out zones 195), and send a targeting message to a netted armed aircraft 140 nearby using any suitable communication technique (e.g., radio or other electromagnetic radiation signaling) as indicated by line 135.

The aircraft 140 has a computer, which hosts the autonomous weapons employment algorithms that consists of three segments namely; the"Weaponeering and Endgame Effects Optimization" box 142, the "Weapon Launch Point and Trajectory Optimization" box 144 and the "Aircraft Auto-Routing" box 146. The Weaponeering and Endgame Effects Optimization 142, selects the best weapon in the inventory that achieves the desired lethality and collateral effects on the target 190. The Weapon Launch Point and Trajectory Optimization 144, optimizes the weapon trajectory and launch point. The Aircraft Auto-Routing 146, dynamically plans a deconflicted aircraft route for weapon delivery.

The aircraft computer also interfaces to the weapon launchers and weapons to initialize and launch weapons autonomously. As described in further details below, the aircraft computer in particular embodiments also transmits data for the CAS ground controller 110 and the pilot to visualize the planned aircraft and weapon routes and warhead lethality and collateral effects on the target area 190—thus providing both the ground controller and pilot oversight of the target engagement. In particular embodiments, the process only proceeds after confirmation by the CAS ground controller 110/pilot after visualization of the planned effects.

The autonomous weapon employment process on the aircraft 140 computer begins by first planning the weapon effects on target and the area around the target, which is performed by the Weaponeering and Endgame Effects Optimization segment. The process selects the best weapon in the inventory and, its desired fuze setting, terminal elevation and heading angles, and terminal weapon speed that meets the lethality and collateral constraints for a target and the area around the target 190 as specified by the CAS ground controller 110. This process is repeated every time a new target engagement request is received from the CAS ground controller 110 or in the case of a moving target, an updated target location is received. This ensures that a new weapon employment solution is computed every time a new target is selected or the collateral area around the target has changed (i.e. in the case of a moving target). The selected weapon and, the desired terminal angles and speed are then sent on to the Weapon Launch Point and Trajectory Optimization 144 for processing.

The Weapon Launch Point and Trajectory Optimization 144 segment shapes the selected weapon's trajectory to accommodate the weapon's aerodynamics and guidance sensors. It ensures that the weapon's sensor acquires target/laser signals (e.g., as shown with lines 125*a*, 125*b*, and 125*c*) to conduct precision guidance. It also designs the weapon's launch conditions (location, heading and speed) to minimize the aircraft's arrival time, maximize the aircraft's standoff range and ensure that the weapon arrives at target with the heading, elevation and speed to meet the weapon effects on target. The desired weapon launch conditions (launch location or corridor, weapon attitude angles and speed) are then sent on to the Aircraft Auto-Routing, 146 for processing.

The Aircraft Auto-Routing 146 segment dynamically plans a deconflicted airspace and survivable aircraft route for weapon delivery. Besides taking into account the desired weapon launch conditions, the aircraft auto-router takes into account the current location of aerial objects in the battle space it receives from any source. It also takes into account the local terrain height and location of obstacles (i.e. high power transmission lines) to avoid aircraft clobber. It also takes into account aircraft 140 survivability by maximizing standoff range from known threat areas. The aircraft 140 route is dynamically re-planned to accommodate changing locations of aerial objects and/or moving targets.

Figure 2:
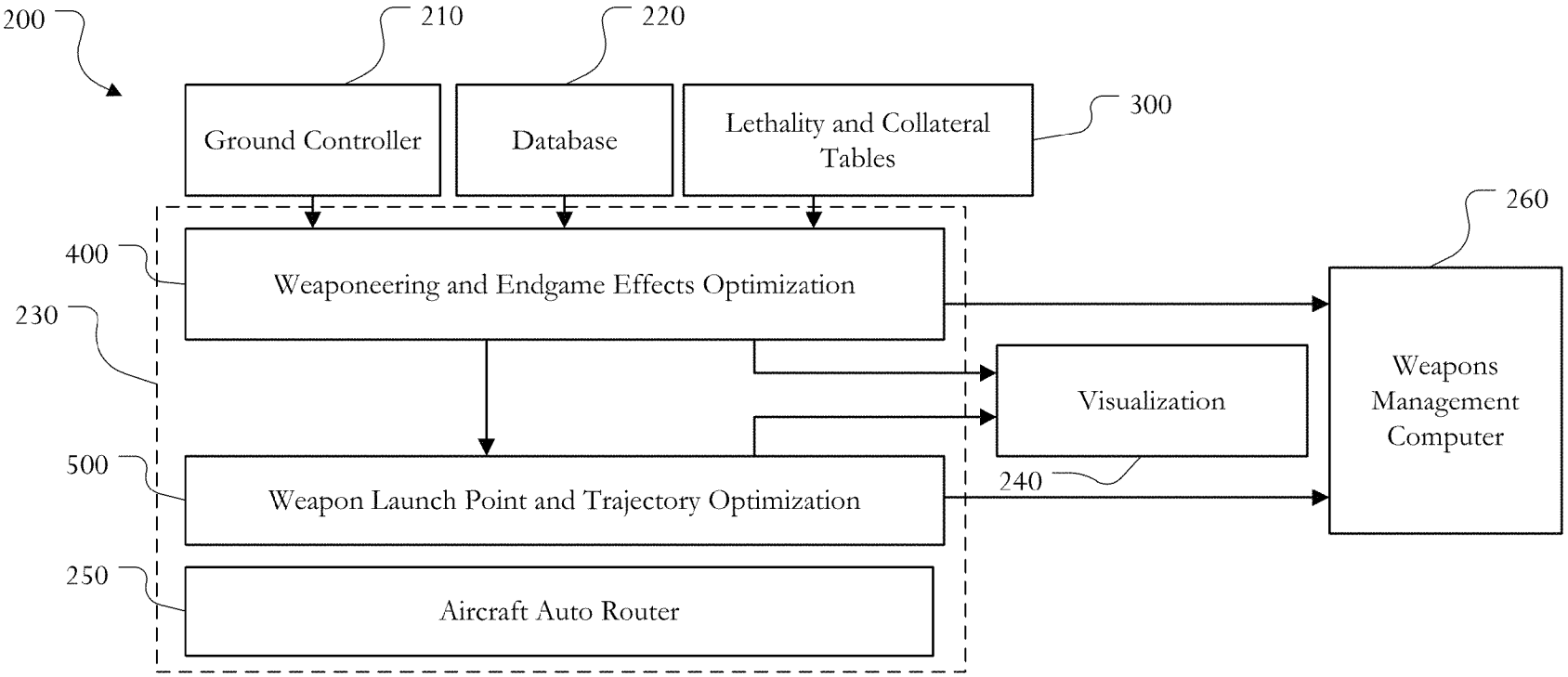
FIG. 2 shows a block diagram of systems and processes, according to an embodiment of the disclosure.
Figure 7:
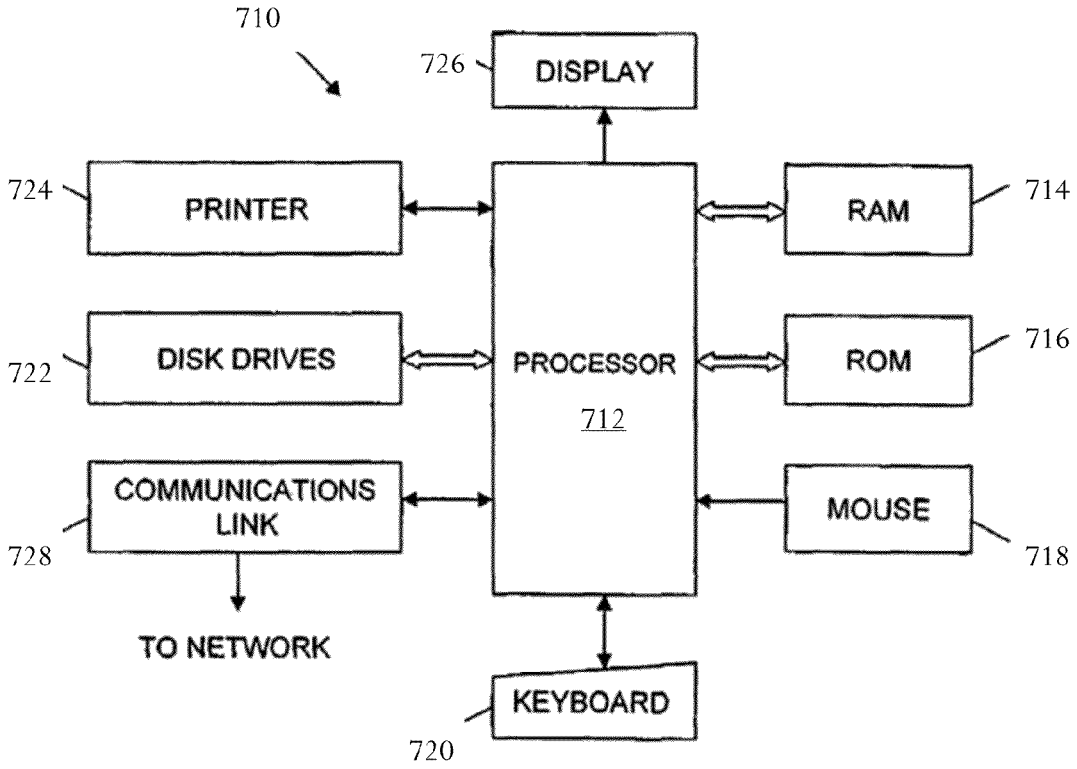
FIG. 7 is an embodiment of a general purpose computer that may be used in connection with other embodiments of the disclosure.

FIG. 2 shows a block diagram 200 of systems and processes, according to an embodiment of the disclosure. A "block" may refer to a process or a computer module that may carry out respective functions of a block. The "block" may include any suitable hardware for carrying out the specified function of the block. FIG. 7, described below, provides non-limiting example of hardware components.

Block 400 is shown as receiving inputs from blocks 210, 220, and 300. At block 210, information is gathered from a ground controller (e.g., CAS controller 110 of FIG. 1) to provide block 400. Such information includes, but is not limited, to target and self location, preferred guidance method, target description, desired effects on target, and collateral effects. Any suitable manner of gathering such information may be utilized, including manual entry or recordation by a sensor (e.g., a GPS sensor for location or other suitable sensor).

At block 220, information from a database is gathered and supplied to block 400. Such information includes, but is not limited to, inventory weapons performance data and terminal engagement rules.

At block 300, there is a generation of target lethality and damage tables for nearly every conceivable scenario that may be encountered for a given weapon and target. The tables generated by block 300 are ingested by process block 400.

Alternatively, output portions of block 300 may become part of block 400. Further details of block 300 are described with reference to FIG. 3.

At block 400, for given constraints and inputs provided by block 300, there is an autonomous determination of, among other things, the best weapon or weapons in inventory and required terminal heading and elevation angles and speed that meets the desired lethality and collateral effects (e.g., as may be received by block 210). Fuze settings for such weapons are also autonomously determined. Further details of block 400 are described with reference to FIG. 4.

According to particular embodiments, block 400 may provide certain items to block 500 such as, but not limited to, a selected weapon, a terminal heading and elevation angles, a terminal velocity, and terminal heading and elevation angles. At block 500, for given constraints and the input from block 400, there is an autonomous determination of among other things, the optimal weapon launch conditions and trajectory. For example, block 500 may use knowledge of an armed aircraft location, a target location, weapon terminal heading and elevation angles, and speed requirements to formulate a weapon trajectory. Additionally, block 500 in certain embodiments autonomously maximizes a weapon launch range from a target to ensure the aircraft's survivability. Additionally, block 500 may autonomously utilize weapon terminal guidance sensor constraints to shape the weapon trajectory to ensure target/laser signal acquisition and high accuracy terminal guidance. Further details of block 500 are described with reference to FIG. 5.

According to particular embodiments, the block 400 additionally yields warhead effects graphics and predicted performance based on a selected weapon whereas the block 500 additionally yields weapon trajectory graphics based on the selected launch conditions and trajectory. With such information, the visualization block 240 can provide a controller on the ground and the pilot an expected result of the combined autonomous blocks 400, 500. With such a visualization check, the controller or pilot can allow the weapon release process to proceed.

The weapons management block 260 receives, for example, the selected weapon or weapons from block 400 and the associated weapon/s trajectory and launch conditions from block 500. Additionally, the weapons management block 260 may receive a confirmation from a controller or pilot that visualized the expected results.

Also shown is a block 250 for aircraft auto routing. The block 250 may receive weapon launch conditions from block 500 and use, among other things, the knowledge of aircraft performance, terrain elevation, obstacle locations, threat locations, and incoming air-tracks to generate a potential ingress corridor that is fed back to block 500. Further details of block 250 are described with reference to FIG. 5.

In FIG. 2, the items in block 230 are those that may generally be carried out autonomously. In particular embodiments, other blocks outside of block 230 may also be carried out autonomously. Additionally, in certain embodiments, portions of items in block 230 may be not carried out autonomously.

Figure 3:
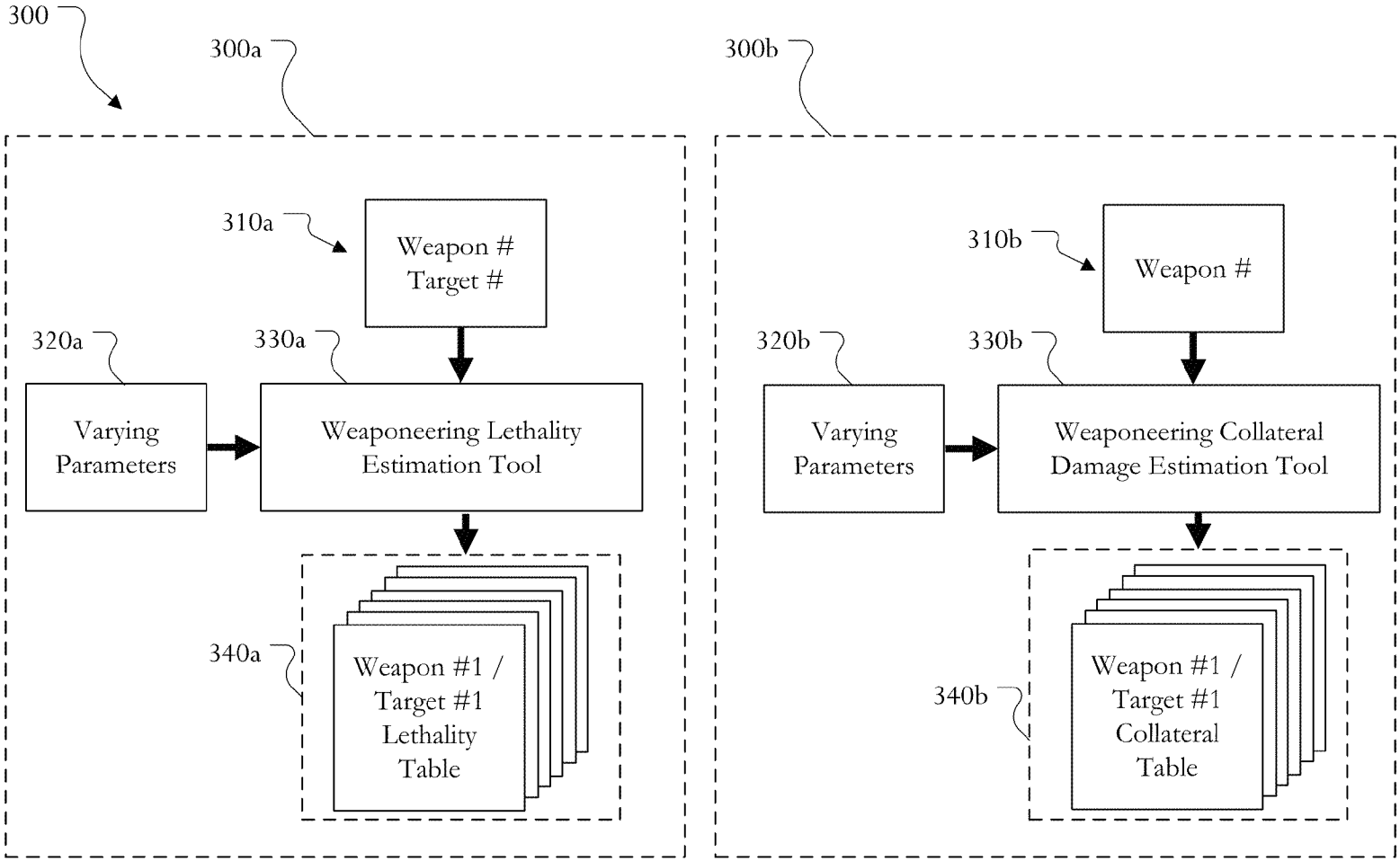
FIG. 3 shows block for generating target lethality and damage tables according to an embodiment of the disclosure.

FIG. 3 shows block 300 for generating target lethality and damage tables according to an embodiment of the disclosure. Block 300*a* generally refers to the lethality table generation whereas block 300*b* generally refers to the collateral table generation. According to particular embodiments, block 300 is an off-line process that generates the weapon lethality and collateral tables that, in turn, work with other process in real-time for overall autonomous weapons employment process. Although block 300 is described as an off-line process in this embodiment, in other embodiments, block 300 may not necessarily be off-line. As a non-limiting example, the tables may be updated in the field to accommodate new scenarios.

To ensure safety and accuracy of the weapon performance tables, certain embodiments of the disclosure use Government certified weaponeering lethality tools—some of which were designed for manual weaponeering—to generate a series of lethality tables for every weapon in the inventory against every possible target. Such varied weapon input numbers and target numbers are respectively labeled as blocks 310*a*, 310*b* where the "#" indicates a plurality (e.g., number, n), of each. Each respective weapon number and target number is cross-referenced against varying parameters 320*a*, 320*b*. Non-limiting examples of varying parameters for block 320*a* include varying weapon fuze settings, varying targeting error, varying guidance error, varying weapon terminal heading and elevation angles and varying weapon speed. Non-limiting examples of varying parameters for block 320*b* include varying targeting error, varying guidance error, varying weapon terminal heading and elevation angles, and varying weapon speed.

The weaponeering lethality estimation tools 330*a*,330*b* respectively cross-references inputs from block 320*a*, 320*b* and 310*a*, 310*b* to yield respective lethality tables 340*a* and collateral tables 340*b*. The lethality tables 340*a* specify weapon lethality effects on a specific target as a function of warhead fuze settings, targeting error, guidance error, weapon terminal heading and elevation angles and weapon terminal speed. Similarly, the collateral damage tables 340*b* specify for every weapon in the inventory collateral effects as a function of targeting error, guidance error, weapon terminal heading and elevation angles and weapon terminal speed. These lethality and collateral tables 340*a*, 340*b* are stored in the aircraft's fire control computer for real-time processing during a target engagement.

Figure 4:
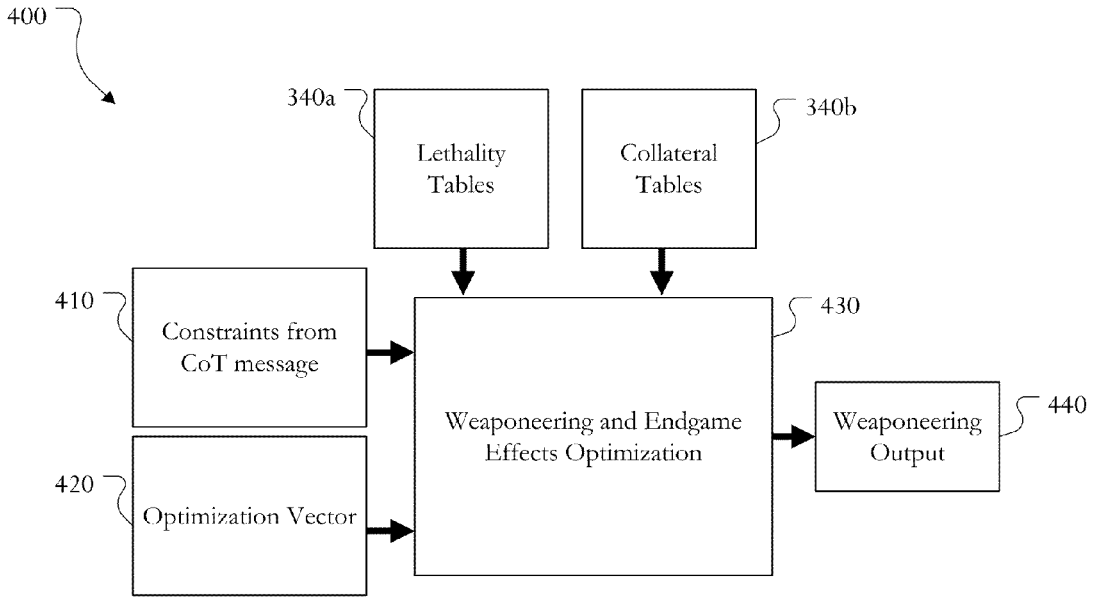
FIG. 4 shows a block that, for given constraints, determines among other things, the best weapon or weapons and fuze settings for such weapons, according to an embodiment of the disclosure.

FIG. 4 shows a block 400 that, for given constraints, determines among other things, the best weapon or weapons and fuze settings for such weapons, according to an embodiment of the disclosure.

According to embodiments of the disclosure, the CAS ground controller (e.g., item 11 of FIG. 1) identifies the target, measures its location and speed, identifies the collateral constraints around the target, and generates a Call-for-Fire (CFF) Cursor-on-Target (CoT) message that is then uplinked to an armed aircraft nearby. The CoT message, among other things, may contain the ground controller's location, target location and speed, targeting error estimate, target type, desired lethality on target, and collateral constraints around the target.

As shown in FIG. 4, the constraints from the CoT message 400 are fed into a weaponeering and endgame effects optimization tool 430 along with the lethality tables 340*a* and collateral tables 340*b* from FIG. 3. The weaponeering and endgame effects optimization tool 430, according to particular embodiments, may be located on an aircraft. In particular embodiments, some or all of the entries in the lethality tables 340*a*, 340*b* may be generated in a process other than that described with reference to FIG. 3.

Optimization vectors 420 may additionally be fed into weaponeering and endgame effects optimization tool 430. Non-limiting examples include weapon optimization vectors, fuze settings, terminal heading with respect to target, and terminal speed.

In particular embodiments, upon receiving the CoT message 400, an aircraft's fire control computer may immediately process such information using the weaponeering and endgame effects optimization tool 430. In particular embodiments, the weaponeering and endgame effects optimization tool 430 may operate in real time to quickly generate weaponeering outputs 440. In some embodiments, the weaponeering and endgame effects optimization tool 430 may generate the weaponeering outputs 440 in less than two seconds after receipt of the constraints from the CoT message 410. In other embodiments, the weaponeering outputs may be generated in more than two seconds.

As referenced above, as part of the selection process, the weaponeering and endgame effects optimization tool 430 may analyze all available weapons in inventory to determine the optimal one for the given constraints. In particular embodiments, the weaponeering outputs 440 include, but are not limited to, the desired weapon, fuze setting, terminal heading and elevation angles and terminal speed.

Thus, one can see that the weaponeering and endgame effects optimization tool 430 finds the best weapon, fuze setting, terminal elevation and heading angles and speed that meets the constraints, which may include the target type, predicted targeting error, lethality and collateral effects on target. Any of a variety of techniques and algorithm may be utilized to yield weaponeering output 440 including solving a set of equations, iterative processing, best fit analysis, and brute analysis. One of ordinary skill in the art will recognize other problem solving algorithms may be utilized after review of this disclosure.

Figure 5:
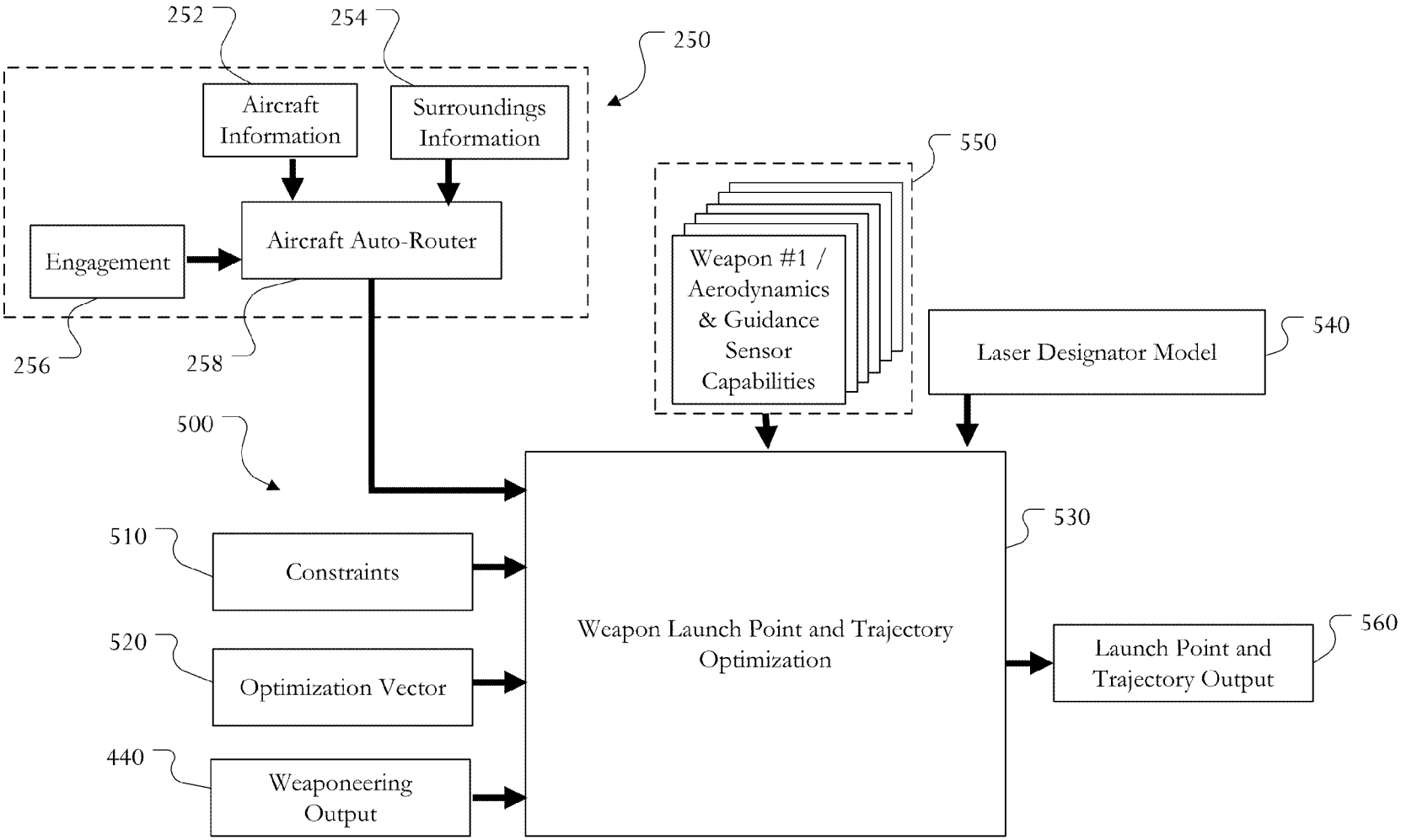
FIG. 5 shows a block that, for given constrains, determines among other things, the optimal weapon launch conditions and trajectory, according to an embodiment of the disclosure.

FIG. 5 shows a block 500 that, for given constrains, determines among other things, the optimal weapon launch conditions and trajectory, according to an embodiment of the disclosure.

Unlike conventional manned weapon launch methods where the weapon is launched as soon as the target is in the launch acceptability region (LAR), certain embodiments employ autonomous weapons algorithms that plan a single optimized weapon trajectory and a single weapon launch point (position, attitude and speed) that can easily be achieved by the aircraft.

According to certain embodiments, one of the functions of the block 500 is to optimize the weapon's launch location along with attitude and speed to minimize the aircraft's ingress time to launch the weapon, to maximize the aircraft's standoff range to target, and to ensure that the weapon arrives at the target with the correct attitude and speed in order to ensure the desired lethality and collateral damage at target.

In process 500, a weapon launch point and trajectory optimization tool 530 takes and analyzes a variety of inputs to yield a launch point and trajectory output 560. According to particular embodiments, the launch point and trajectory output includes weapon launch conditions and a planned weapon trajectory.

One of the inputs into the weapon launch point and trajectory optimization tool 530 is the weaponeering output 440 from block 400 of FIG. 5. As described above, according to particular embodiments, the weaponeering outputs 440 includes, but is not limited to, the desired weapon, fuze setting, terminal heading and elevation angles and terminal speed.

Another input into the weapon launch point and trajectory optimization tool 530 is constraints 510 that may be fed from a combination of the aircraft or ground forces. For example, where a CoT message is communicated from ground forces, the location of transmission of the message, target location, target information and laser designation source may be part of the constraints 510. Additionally, the aircraft may supply a current aircraft state vector and wind estimates. Further, weather may be obtained from ground forces or a global information grid (GIG).

Yet another input into the weapon launch point and trajectory optimization tool 530 is optimization vectors 520. Such optimization vectors may include, but are not limited to weapon launch conditions (position, attitude, velocity) and weapon trajectory (position, attitude, and velocity).

Yet another input into the weapon launch point and trajectory optimization tool 530 is information on weapon aerodynamics and guidance sensor capability 550 as well as laser designator model information 540. The laser designator model information may include, but is not limited to laser power, angular divergence and weather conditions.

In particular embodiments, the weapon launch point and trajectory optimization tool 530 shapes the weapons' trajectory to accommodate the weapon's guidance sensor. Accordingly, the algorithm or algorithms in the weapon launch point and trajectory optimization tool 530 take into account the weapon's aerodynamics and guidance capabilities. If the weapon's guidance uses GPS then the algorithm checks to make sure GPS is available. If the weapon's guidance uses laser guidance, then the algorithm uses prior knowledge of: onboard aircraft laser designation capability, CAS ground controller's laser designation capabilities and the locations of the aircraft, target and CAS ground controller, knowledge of the target's reflectance and weather conditions (i.e. cloud cover and rain) to select the best guidance approach.

The algorithm or algorithms in the weapon launch point and trajectory optimization tool 530 also uses knowledge of these capabilities to shape the trajectory to ensure the laser signal is contained in the weapon seeker's field-of-view from acquisition to impact. If the weapon uses electro-optical/infrared (EO/IR) or semi-active radar (SAR) seeker guidance then the algorithm or algorithms uses knowledge of these sensor capabilities to shape the trajectory to ensure the target is contained in the weapon seeker's field-of-view from target acquisition to impact. If a preferred attack direction is specified, the algorithm or algorithms use that and the knowledge of the aircraft's current position and heading, the weapon's aerodynamics and guidance capability to shape a trajectory from launch to impact.

Also shown in FIG. 5 is the Auto-Router block 250 briefly referenced in FIG. 2, which may also provide information to the weapon launch point and trajectory optimization tool 530 according to embodiments of the disclosure. The Auto-Router block 250 generally determines a route of an aircraft to a particular location through aircraft information 252, surroundings information 254, and engagement parameters 256. The aircraft information 252 may include, among other things, a performance database for the aircraft along with guidance parameters for the aircraft. The surroundings information 254 may include a terrain elevation database, an obstacle database, a threat database, and incoming air-tracks information. The engagement information 256 may include the aircraft's location and the target location and speed. Such a combination of information may be ingested by an aircraft Auto-Router 258 to yield a possible aircraft ingress corridor that can be fed into the weapon launch point and trajectory optimization tool.

Figure 6:
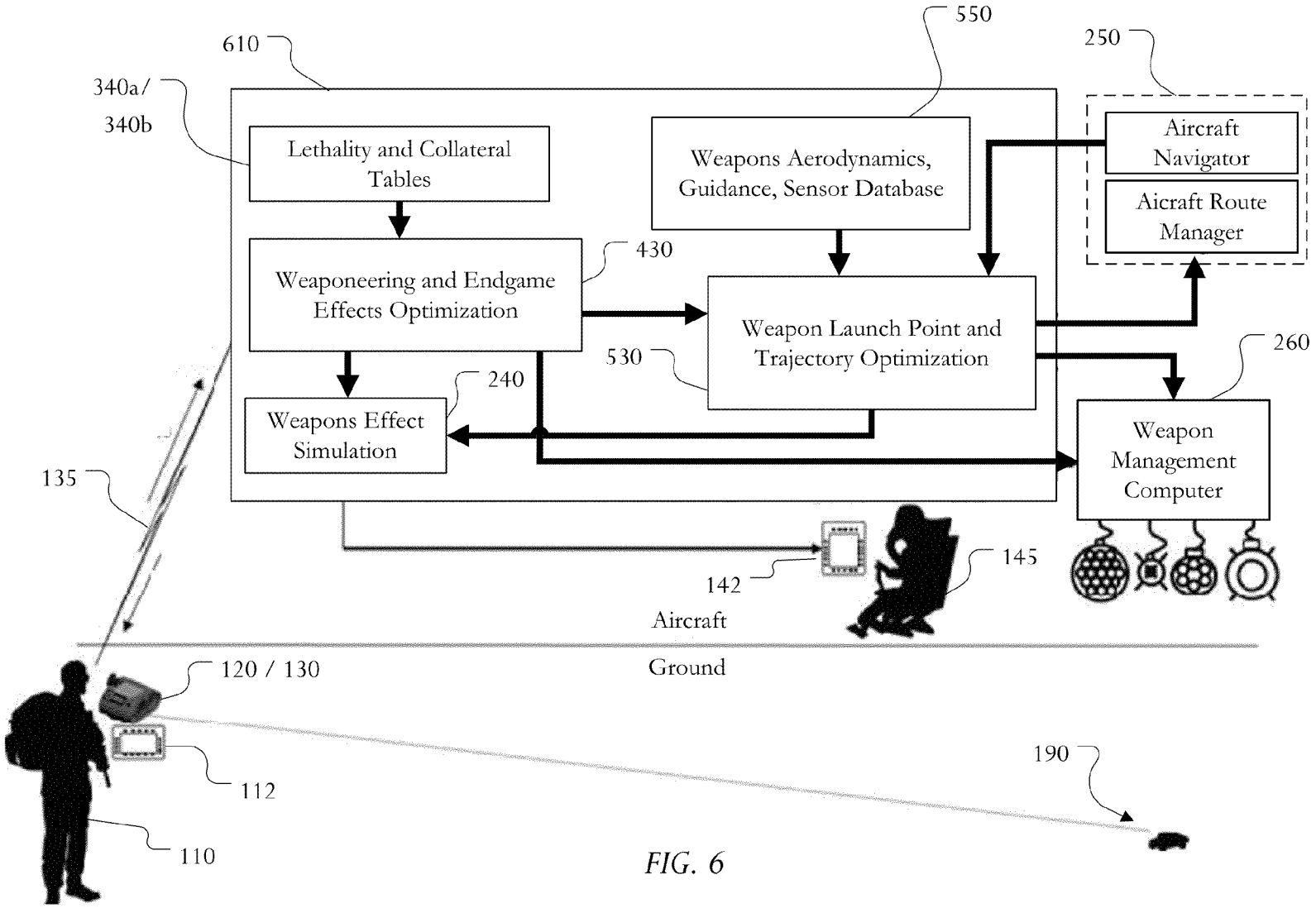
FIG. 6 is another simplified block diagram, illustrating certain aspect of embodiments of the disclosure.

FIG. 6 is another simplified block diagram, illustrating certain aspect of embodiments of the disclosure. Many of the items bear the same labels provided with reference to other FIGURES, and, accordingly correspond to the features describe in such other FIGURES. For purpose of brevity, such components will not necessarily be described again. FIG. 6.

The tools described herein, for example, the weaponeering and endgame effects optimization tool 430 and weapon launch point and trajectory optimization tool 530 may be carried out on a fire control computer 610 within the aircraft.

Although described as "a computer," the fire control computer 610 may be more than one computer. Information such as that from the lethality and collateral tables 340*a*, 340*b* may be on the computer, for example, in suitable memory. Additionally, weapons aerodynamics, guidance, and sensor database may also be located with suitable memory on the fire control compute 610. Each of the weaponeering and endgame effects optimization tool 430 and weapon launch point and trajectory optimization tool 530 may be part of a same or different programs and can be executed by any suitable processor or processors.

The weapon management computer 260 may receive the outputs from the weaponeering and endgame effects optimization tool 430 and weapon launch point and trajectory optimization tool 530 (e.g., weapon guidance/trajectory parameters and selected weapon/terminal heading and elevation angles/speed) and also potentially input from a CAS ground controller 110 or pilot 145 confirming after visualizing the output communicated from weapon effects simulation 240 to display 142 or display 112. Upon receiving such inputs, weapons management computer 260 may initiate its weapon launch process.

FIG. 7 is an embodiment of a general purpose computer 710 that may be used in connection with other embodiments of the disclosure to carry out any of the above-referenced functions. In particular embodiments, the general purpose computer may correspond to the fire control computer 610 of FIG. 6.

General purpose computer 710 may generally be adapted to execute any of the known OS2, UNIX, Mac-OS, Linux, Android and/or Windows Operating Systems or other operating systems. The general purpose computer 710 in this embodiment includes a processor 712, a random access memory (RAM) 714, a read only memory (ROM) 716, a mouse 718, a keyboard 720 and input/output devices such as a printer 724, disk drives 722, a display 726 and a communications link 728. In other embodiments, the general purpose computer 710 may include more, fewer, or other component parts. Embodiments of the present disclosure may include programs that may be stored in the RAM 714, the ROM 716 or the disk drives 722 and may be executed by the processor 712 in order to carry out functions described herein. The communications link 728 may be connected to a computer network or a variety of other communicative platforms including, but not limited to, a public or private data network; a local area network (LAN); a metropolitan area network (MAN); a wide area network (WAN); a wireline or wireless network; a local, regional, or global communication network; an optical network; a satellite network; an enterprise intranet; other suitable communication links; or any combination of the preceding. Disk drives 722 may include a variety of types of storage media such as, for example, floppy disk drives, hard disk drives, CD ROM drives, DVD ROM drives, magnetic tape drives or other suitable storage media. Although this embodiment employs a plurality of disk drives 722, a single disk drive 722 may be used without departing from the scope of the disclosure.

Although FIG. 7 provides one embodiment of a computer that may be utilized with other embodiments of the disclosure, such other embodiments may additionally utilize computers other than general purpose computers as well as general purpose computers without conventional operating systems. Additionally, embodiments of the disclosure may also employ multiple general purpose computers 710 or other computers networked together in a computer network. Most commonly, multiple general purpose computers 710 or other computers may be networked through the Internet and/or in a client server network. Embodiments of the disclosure may also be used with a combination of separate computer networks each linked together by a private or a public network.

Several embodiments of the disclosure may include logic contained within a medium. In the embodiment of FIG. 7, the logic includes computer software executable on the general purpose computer 710. The medium may include the RAM 714, the ROM 716, the disk drives 722, or other mediums. In other embodiments, the logic may be contained within hardware configuration or a combination of software and hardware configurations.

The logic may also be embedded within any other suitable medium without departing from the scope of the disclosure. Additionally, in particular embodiments, certain, some, or all of the logic may be performed automatically without human intervention. It will be understood that well known processes have not been described in detail and have been omitted for brevity. Although specific steps, structures and materials may have been described, the present disclosure may not be limited to these specifics, and others may be substituted as it is well understood by those skilled in the art, and various steps may not necessarily be performed in the sequences shown.

It may be advantageous to set forth definitions of certain words and phrases used throughout this patent document. The terms "include" and "comprise," as well as derivatives thereof, mean inclusion without limitation. The term "or" is inclusive, meaning and/or. The phrase "associated with," as well as derivatives thereof, may mean to include, be included within, interconnect with, contain, be contained within, connect to or with, couple to or with, be communicable with, cooperate with, interleave, juxtapose, be proximate to, be bound to or with, have, have a property of, have a relationship to or with, or the like. The term "controller" means any device, system or part thereof that controls at least one operation, such a device may be implemented in hardware, firmware or software, or some combination of at least two of the same. It should be noted that the functionality associated with any particular controller may be centralized or distributed, whether locally or remotely While this disclosure has described certain embodiments and generally associated methods, alterations and permutations of these embodiments and methods will be apparent to those skilled in the art. Accordingly, the above description of example embodiments does not define or constrain this disclosure. Other changes, substitutions, and alterations are also possible without departing from the spirit and scope of this disclosure, as defined by the following claims.

What is claimed is:

1. A system for autonomous weapon employment planning, the system comprising one or more processors configured to:

receive target information, desired lethality and collateral effects on a target; and autonomously select at least one weapon and fuze setting from an inventory of weapons based on the received target information, desired lethality and collateral effects.

2. The system of claim 1, wherein the one or more processors are configured to autonomously select the at least one weapon and fuze setting based on one or more pre-generated tables that specify weapon lethality effects on at least one specific target as a function of warhead fuze settings, targeting error, guidance error, weapon terminal heading and elevation angles and weapon terminal speed.

3. The system of claim 2, wherein the one or more processors are configured to autonomously select the at least one weapon and fuze setting further based on one or more pre-generated tables that specify collateral damage extent (area or volume) for weapons as a function of targeting error, guidance error, weapon terminal heading and elevation angles and weapon terminal speed.

4. The system of claim 1, wherein the one or more processors are further configured to autonomously select heading and elevation angles and speed for the at least one weapon.

5. The system of claim 1, wherein the one or more processors are further configured to:

autonomously plan weapon launch conditions for the at least one weapon.

6. The system of claim 5, wherein the weapon launch conditions include at least one of a launch point or a launch corridor and trajectory.

7. The system of claim 5, wherein the one or more processors are further configured to optimize the autonomously planned weapon launch conditions by minimizing a time to launch for the at least one weapon and by maximizing an aircraft's standoff range.

8. The system of claim 5, wherein the at least one weapon is autonomously launched according to the weapon launch conditions.

9. The system of claim 5, wherein the one or more processors are further configured to provide data for an expected graphical depiction of the at least one weapon according to the weapon launch conditions.

10. The system of claim 5, wherein the one or more processors, in autonomously planning the weapon launch conditions, are configured to:

provide potential weapon launch conditions to an aircraft auto-router; and receive, from the aircraft auto-router, a potential ingress corridor, the potential ingress corridor considered in the autonomous planning of the weapon launch conditions.

11. A method for autonomous weapon effects planning comprising, using one or more processors:

receiving lethality and collateral effects information on a target; and autonomously selecting at least one weapon and fuze setting from an inventory of weapons based on the received lethality and collateral effects information.

12. The method of claim 11, wherein the autonomous selection is based on one or more pre-generated tables that specify weapon lethality effects on at least one specific target as a function of warhead fuze settings, targeting error, guidance error, weapon terminal heading and elevation angles and weapon terminal speed.

13. The method of claim 12, wherein the autonomous selection is further based on one or more pre-generated tables that specify collateral damage for weapons as a function of targeting error, guidance error, weapon terminal heading and elevation angles and weapon terminal speed.

14. The method of claim 11, wherein the autonomous selection further includes autonomously selecting heading and elevation angles and speed for the at least one weapon.

15. The method of claim 11, further comprising:

autonomously planning weapon launch conditions for the at least one weapon.

16. The method of claim 15, wherein the weapon launch conditions include a launch point and trajectory.

17. The method of claim 15, further comprising:

optimizing the weapon launch conditions by minimizing a time to launch for the at least one weapon and by maximizing an aircraft's standoff range.

18. The method of claim 15, further comprising:

autonomously launching the at least one weapon according to the weapon launch conditions.

19. The method of claim 15, further comprising:

providing data for an expected graphical depiction of the at least one weapon according to the weapon launch conditions.

20. The method of claim 15, further comprising:

providing potential weapon launch conditions to an aircraft auto-router; and receiving, from the aircraft auto-router, a potential ingress corridor, the potential ingress corridor considered in the autonomous planning of the weapon launch conditions.

21. A non-transitory computer readable medium containing instructions that, when executed by at least one processor, cause the at least one processor to: receive lethality and collateral effects information on a target; and autonomously select at least one weapon and fuze setting from an inventory of weapons based on the received lethality and collateral effects information.

22. The non-transitory computer readable medium of claim 21, further containing instructions that, when executed by the at least one processor, cause the at least one processor to: autonomously plan weapon launch conditions for the at least one weapon; and autonomously launch the at least one weapon according to the weapon conditions.

* * * * *